United States Patent [19]

Miller

[11] 4,410,183

[45] Oct. 18, 1983

[54] PRESTRESSED ARROW SHAFT

[76] Inventor: Jack V. Miller, 700 N. Auburn Ave., Sierra Madre, Calif. 91024

[21] Appl. No.: 416,864

[22] Filed: Sep. 13, 1982

[51] Int. Cl.[3] ..... F41B 5/02

[52] U.S. Cl. ..... 273/416

[58] Field of Search ..... 273/416, 419, 420, 423, 273/80 B

[56] References Cited

U.S. PATENT DOCUMENTS

| | | | |
|---|---|---|---|
| 2,078,728 | 4/1937 | Lard | 273/80 B |
| 2,992,828 | 7/1961 | Stewart | 273/80 B |
| 4,252,325 | 2/1981 | Weems et al. | 273/416 |

FOREIGN PATENT DOCUMENTS

| | | | |
|---|---|---|---|
| 927501 | 5/1947 | France | 273/420 |

*Primary Examiner*—Paul E. Shapiro

[57] ABSTRACT

A cylindrical tubular arrow shaft having a head end and a nock end with a length "L" is provided with a prestressing tension wire of approximately a length "L" with one end anchored at the head end of the arrow shaft and the other end anchored at the nock end, the tension wire having at least one elastomeric washer closely fitting the inside diameter of the shaft tube and supporting the tension wire coaxially with the shaft tube, the elastomeric washer spacing being approximately equidistant along length "L".

6 Claims, 4 Drawing Figures

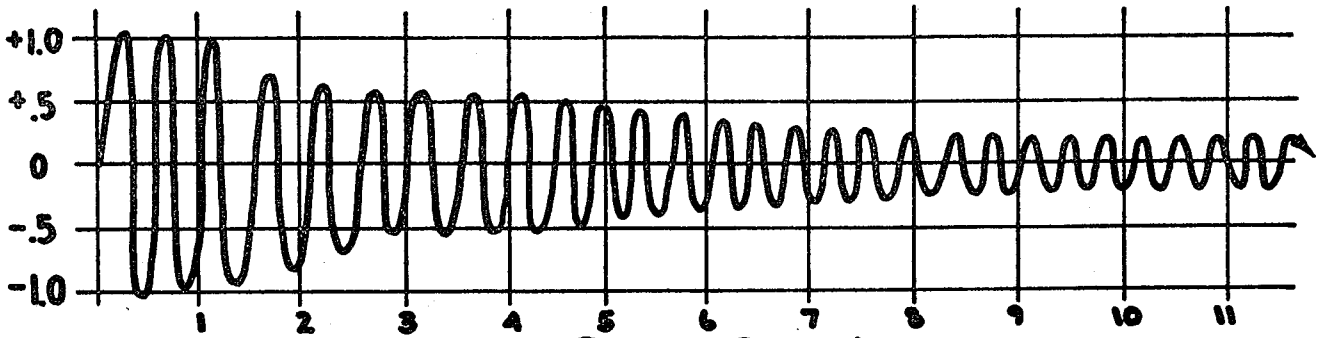
Fig. 3- Prior Art
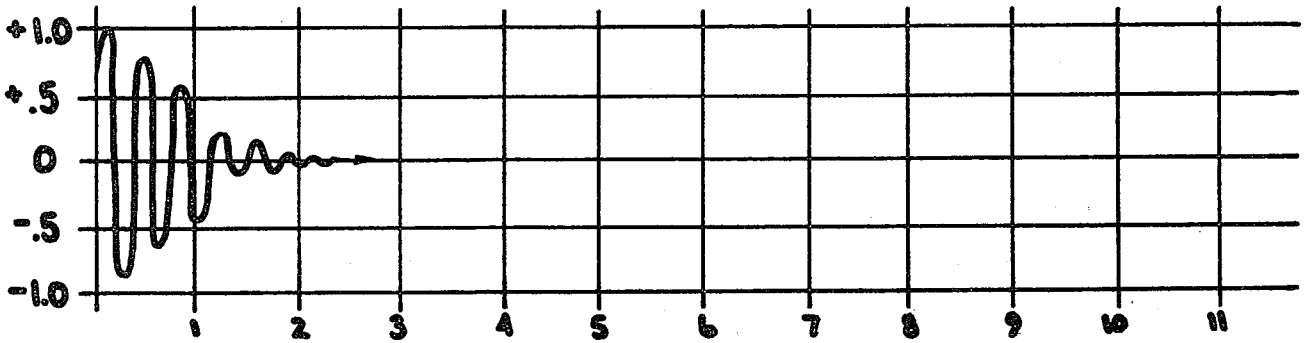
Fig. 4

PRESTRESSED ARROW SHAFT

BACKGROUND OF THE INVENTION

The dynamics of every archery arrow flight are readily observed by an archer, but are poorly understood. The largest and most easily seen perturbation is known as "fishtailing", in which the arrow may be seen to oscillate in azimuth after leaving the bow. The second largest perturbation in known as "porpoising", in which the arrow oscillates in elevation in flight. Since the fletching, or feathers, are attached in a slightly twisted helix pattern, the arrow also rolls continuously about is flight axis. Therefore as the arrow oscillates in both pitch and yaw as it rolls, the resulting flight pattern is usually a spiral path of some amplitude to the target. The skill of the archer is not only applied to aiming the arrow at the release time, but is also applied to releasing the string and nock, while avoiding application of any perturbing torques to the bow handle. All these efforts are directed towards minimizing the input perturbations to the arrow at the moment of release.

Once released, with whatever perturbations may have been applied to the arrow, the dynamics of the arrow are a very complex set of compromises. The fastest arrow, with the shortest flight time to target, will have the least error in trajectory due to gravity and wind, and the fastest reponse time to a moving target. However, the lightest arrow is the slimmest and most flexible. The inventor has found that flexing of the arrow in flight is a most significant contributor to the pitch and yaw components of the spiral flight path. The arrow is imparted with a bending moment in pitch from unequal loading of the bow limbs, slight variations in the nocking point of the arrow on the bow string, and straightness of the arrow shaft. The arrow is also imparted with a bending moment in yaw from torque on the bow handle, skew of the bow limbs, aerodynamic imbalance of the bow string, error in the arrow rest on the bow handle, and also variations in straightness of the arrow. All of these errors exist in every arrow launched, they merely vary in magnitude.

The accuracy of arrow flight is dependent on two primary factors, the foregoing launching errors, and the sensitivity of the arrow to those errors. If the arrow is very flexible it instantaneously curves along its length, so the fletching is simply not pointed in the same direction as the arrowhead. Therefore the arrow must deviate from a straight line of flight. The instantaneous curve of the arrow shaft is constantly changing as the arrow resonates at its characteristic frequency and amplitude, passing through zero flexure where the arrow is perfectly straight, to the opposite direction curve at full amplitude repeatedly, passing through complex and somewhat unpredictable Lassijou figures in a decay time that may be longer than the flight time.

The purpose of this invention is to provide an arrow with an inherently stiff and highly damped structure, having a greatly reduced initial bending amplitude at the moment of launch, and very quickly decaying to zero bending; whereby the arrow shaft remains straight in flight. The inventor has measured flexure amplitudes of as much as $\pm 1.0$ inch during decay times of over 10 seconds in "high quality" present state-of-the-art arrow shafts, far longer than the vast majority of target or hunting shooting ranges. The inventor then added the prestressing to the same arrow shafts according to the present invention, cutting the amplitude of curvature to less than half that of the unstressed arrow shaft, and also reducing the oscillation decay time to less than two seconds.

SUMMARY OF THE INVENTION

A cylindrical tubular arrow shaft, typically made of aluminum tubing has a head end and a nock end, and a length "L". A prestressing means comprising a small diameter cable or wire is also approximately the same length at the arrow shaft, and is anchored centrally disposed on the central axis of the arrow shaft both at the head end and the nock end, the prestressing wire being tensioned so as to place the arrow shaft tubing in compression. One or more elastomer washers are fitted about the tension wire, fit snugly on the wire, and also fit snugly within the inside diameter of the shaft tubing. The elastomeric washers provide high damping and also provide strong centration of the tension wire within the tube. The tension wire is provided with a substantially higher modulus of elasticity than the shaft tubing, causing a strong restoring moment during deflection of the shaft.

BRIEF DESCRIPTION OF THE DRAWINGS

FIG. 3 is a typical prior art oscillation decay curve for a cantelever mounted arrow shaft; and FIG. 4 is a typical oscillation decay curve for a prestressed arrow shaft, cantelever mounted, according to the present invention.

DETAILED DESCRIPTION OF THE DRAWINGS

Figure 1:
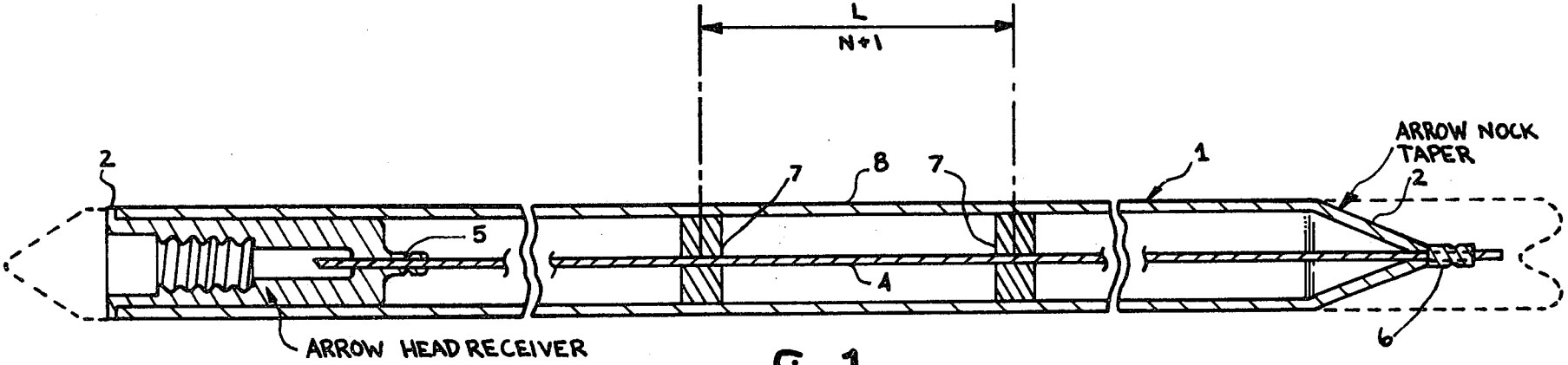
FIG. 1 is a segmented cross-sectional view of the arrow shaft according to the present invention.

In FIG. 1 an arrow shaft 1 is shown having a head end 2 and a nock end 3. A prestress wire 4 is suspended in tension along the central axis of the arrow shaft 1 by a head attachment means 5 and a nock attachment means 6. Damping and centration washers 7 fit snugly onto tension mean 4 and also fit snugly within the inside diameter of shaft tube 8, the spacing of the damping and centration washers 7 from the ends of the shaft tube 8 and between washers 7 a distance of the arrow length L divided by the number of washers 7 plus one.

Figure 2:
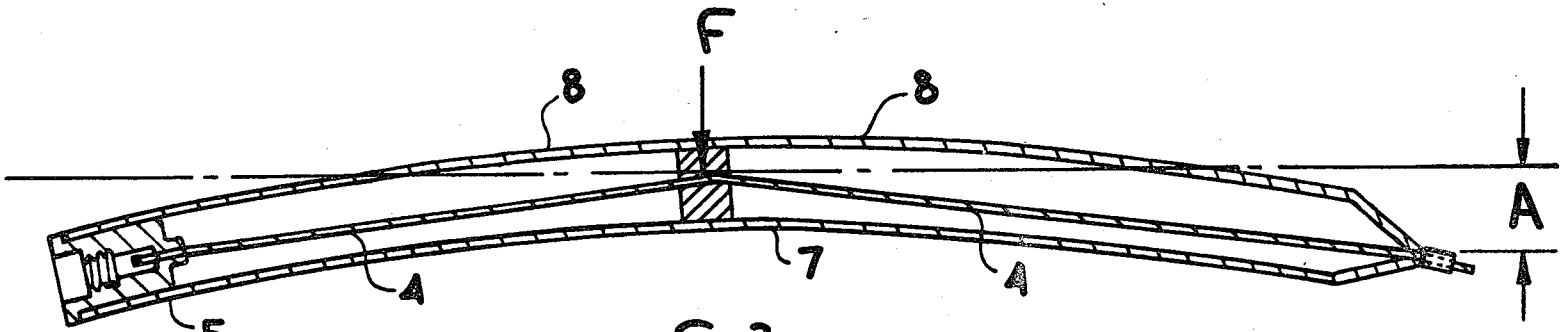
FIG. 2 is a cross-sectional view of the arrow of FIG. 1, shown shortened for clarity, and shown in a flexed condition.

In FIG. 2 arrow shaft 1 is shown bent to an emplitude A on each end, wherein the tension means 4 is held in relative centration in the center of the bend by washer 7. Arrow shaft tube 8 is typically made of a hard aluminum alloy, and tension means 4 is made of a high-strength steel wire. With the arrow shaft bent as shown in FIG. 2 the high modulus of elasticity of the steel wire tension means 4 provides a high restoring force to return the shaft to the straight condition by the application of a high side force F on the tension wire at the center of the bend. Obviously, as the shaft returns to straight as shown in FIG. 1, the restoring force F instantaneously returns to zero, even though the wire remains in tension, thereby limiting the oscillation. Also the washer(s) 7 are selected of materials characterized by high damping coefficients, so energy of the oscillation is absorbed by the elastomer and converted to thermal energy, typical of high density elastomeric foams.

In FIG. 3 a typical oscillation decay curve is shown for a cantelever mounted arrow shaft of present prior art design.

In FIG. 4 a typical oscillation decay curve is shown for a cantelever mounted arrow shaft of the same materials and dimensions as used in FIG. 3, but with the prestressing and damping means installed according to the present invention.

I claim:

1. A cylindrical, tubular arrow shaft having a head end, a nock end and a length L is provided with a coaxially disposed prestressing means with one end anchored at the head end, the other end anchored at the nock end, said prestressing means having at least one elastomeric washer coaxially disposed about the prestressing means and closely fitting within the inside diameter of the arrow shaft tube, the elastomeric washer spacing being approximately equidistant along length L.

2. An arrow shaft according to claim 1 in which the prestressing means is a length of wire having a higher modulus of elasticity than the shaft tube.

3. An arrow shaft according to claim 1 in which the prestressing means is a length of braided cable having a higher modulus of elasticity than the shaft tube.

4. An arrow shaft according to claim 1 in which the prestressing means is crimp attached to the arrow head receiver at the head end.

5. An arrow shaft according to claim 1 in which the prestessing means is crimp attached to a ferrule at the nock end.

6. An arrow shaft according to claim 1 in which the elastomeric washer is made of a foam elastomer material.

* * * * *